US006539187B2

(12) United States Patent
De Kesel

(10) Patent No.: US 6,539,187 B2
(45) Date of Patent: Mar. 25, 2003

(54) TEARABLE SEALING MEMBER

(76) Inventor: Jan De Kesel, J.B. Lombaerrdreaf 21, Drongen (BE), 6-9031

( * ) Notice: Subject to any disclaimer, the term of this patent is extended or adjusted under 35 U.S.C. 154(b) by 0 days.

(21) Appl. No.: 09/902,937

(22) Filed: Jul. 10, 2001

(65) Prior Publication Data

US 2003/0012581 A1 Jan. 16, 2003

(51) Int. Cl.[7] ..... G03G 15/08
(52) U.S. Cl. ..... 399/106; 157/277; 428/114
(58) Field of Search ..... 399/103, 106; 156/277; 383/205, 207; 222/DIG. 1; 428/114

(56) References Cited

U.S. PATENT DOCUMENTS 5,169,696 A * 12/1992 Lang et al. ..... 428/35.2
5,177,540 A * 1/1993 Honda et al. ..... 399/106
5,523,828 A * 6/1996 De Kesel ..... 399/103
5,909,606 A * 6/1999 Fujiwara ..... 399/106
6,041,202 A * 3/2000 Cornelius ..... 399/106
6,054,209 A * 4/2000 Imanishi et al. ..... 428/327
6,156,441 A * 12/2000 Hamada et al. ..... 428/480

* cited by examiner

*Primary Examiner*—Joan Pendegrass
(74) *Attorney, Agent, or Firm*—Darby & Darby

(57) ABSTRACT

Tearable sealing member for unsealably sealing an opening of a developer, said tearable member comprising a seal film for closing the opening and a tearing member, in which the seal film is provided with a means for controlling a minimum width of the strip to be torn out during at least its partial tearing.

46 Claims, 7 Drawing Sheets

TEARABLE SEALING MEMBER

BACKGROUND OF THE INVENTION

The present invention relates to a tearable sealing member provided with a control tearing means for controlling the width of the strip to be torn out of the seal film.

PRIOR ART

Tearable sealing member for unsealably sealing an opening of a developer container for containing a developer for an image forming apparatus are known and marketed for example under the Trademark "Goldseal", CF Technology. Said tearable member comprises a seal film for closing the opening and a tearing member cooperating with the seal film for tearing a strip out of said seal film in a longitudinal direction, from a first end of the strip up to a second end of the strip, so as to define an opening.

Other tearable sealing members exists.

It has been observed that in some case, when tearing the strip out of the sealing film, the width of the strip was reduced during the tearing operation, whereby the width of the opening formed is variable.

In order to solve this problem, it has been proposed to form two parallel grooves in the seal film by means of a laser.

It has also been proposed (U.S. Pat. No. 5,909,606) to fix on a foamed sealing film a tape, a portion of which forms a tearing member. The tape needs to be properly glued on the sealing film for having a correct tearing operation. Moreover, the portion of the tape extending outside of the seal film needs to remain free of gluing means. It is therefore not possible to use a common commercial glue tape for its production.

The present invention relates among others to a tearable sealing member in which the control tearing means acts after the initial tearing, i.e. the tearing of the strip is controlled after the initial tearing.

Tearable sealing member of the invention will be now be disclosed.

BRIEF DESCRIPTION OF THE INVENTION

The invention relates to a tearable sealing member for unsealably sealing an opening of a developer container for containing a developer for an image forming apparatus, said tearable member comprising a seal film for closing the opening and a tearing member cooperating with the seal film for tearing a strip out of said seal film in a longitudinal direction, from a first end of the strip up to a second end of the strip, so as to define an opening. The seal film is provided with a means for controlling a minimum width of the strip to be torn out during at least its partial tearing, preferably at least partly its initial tearing. Said control means defining at least a control tearing line selected from the group consisting of a at least partly curved control tearing line, a control tearing line with at least a portion extending in a direction forming an angle with respect to the longitudinal tearing direction and a control tearing line with a portion having at least a curved portion and a portion extending in a direction forming an angle with respect to the longitudinal tearing direction. When the control tearing line is linear or substantially linear, said control tearing line has advantageously a portion forming an angle comprised between 2° and 88° with respect to the longitudinal direction, preferably between 5 and 85°, most preferably between 15 and 75° with respect to said longitudinal direction. Preferably, the seal film and the tearing member are portions of a same structure, i.e. a film structure comprising a portion forming the seal film and another portion forming the tearing member.

The at least curved control tearing line is advantageously selected from the group consisting of portion of substantially circular lines, portions of ellipses, portions of sinuses, portions of tangents, portion of parabols, portion of hyperbols, portion of spirals, etc., and combinations thereof The sealing film is preferably an easily tearable film or plastic film, comprising one or more layers, for example comprising two superposed layers, such as two or more than two co extruded layers. The film or layer(s) thereof can be prepared from polyester, polyethylene, polypropylene, copolymer (polyethylene/polypropylene), polyamide, polyurethane, high density polyethylene, low density polyethylene, vinyl alcohol copolymer and mixtures thereof. The film or a layer thereof can be foamed, partly foamed or not foamed, and/or can form of a single continuous phase, a continuous phase with a dispersion phase, and/or can be mono axially oriented, bi axially oriented or partly tri axially oriented (embossed), etc. Examples of possible films are disclosed in U.S. Pat. Nos. 5,169,696; 6,054,209; 6,156,441, etc., the scope of which is incorporated by reference.

According to an embodiment, the tearable sealing member comprises a plurality of control means defining two or more control tearing lines distant from each other in the longitudinal direction, each control means being selected from the group consisting of a at least partly curved control tearing line, a control tearing line with at least a portion extending in a direction forming an angle with respect to the longitudinal tearing direction and a control tearing line with a portion having at least a curved portion and a portion extending in a direction forming an angle with respect to the longitudinal tearing direction. For example, said plurality of control means are located on the seal film along its longitudinal direction, so that a first control tearing means act at a first moment of the teasing operation, while at least another control tearing means act at another moment of the tearing operation.

According to a detail of a tearable sealing member of the invention, the tearable sealing member comprises at least a control means defining a first control tearing line for at least a portion of a first edge of the strip to be torn and a second control tearing line for at least a portion of a second edge of the strip to be torn, each control tearing line being selected from the group consisting of a at least partly curved control tearing line, a control tearing line with at least a portion extending in a direction forming an angle with respect to the longitudinal tearing direction and a control tearing line with a portion having at least a curved portion and a portion extending in a direction forming an angle with respect to the longitudinal tearing direction. When the control tearing line is linear or substantially linear, said control tearing line has advantageously a portion forming an angle comprised between 2° and 88° with respect to the longitudinal direction, preferably between 5 and 85°, most preferably between 15 and 75° with respect to said longitudinal direction.

Preferably, the tearable sealing member comprises at least a control means defining a first control tearing line for a portion of a first edge of the strip to be torn and a second control tearing line for a portion of a second edge of the strip to be torn, said first and second control tearing lines being each associated to a means defining a substantially linear tearing line substantially parallel to the longitudinal tearing direction, said first and second control tearing lines being selected from the group consisting of a at least partly curved control tearing line, a control tearing line With at least a portion extending in a direction forming an angle with respect to the longitudinal tearing direction and a control tearing line with a portion having at least a curved portion and a portion extending in a direction forming an angle with respect to the longitudinal tearing direction. The means defining a substantially linear tearing line substantially parallel to the longitudinal tearing direction is advantageously contacting one or more control tearing means.

According to an advantageous embodiment, the seal film has two opposite faces, each face being provided with at least one control tearing means. The control tearing means of the first face are or are not located at places corresponding to the places where the control tearing means of the second face. However, preferably, the control tearing means of the first face are located at places corresponding substantially to the places where the control tearing means of the second face.

According to an advantageous embodiment, the control tearing means present on a first face of the seal film and the control tearing means present on the second face of the seal film opposite to the first face are linked together at least in the vicinity of the second end of the strip. Preferably, the first control tearing means and the second control tearing means are connected together outside of the sealing film.

The control tearing means is formed by a means selected from the group consisting of a layer applied on a portion of the sealing film, an additional film applied on a portion of the sealing film, a groove formed in the sealing film, recesses formed in the sealing film, elements printed on a portion of the sealing is film, elements glued on a portion of the seal film, elements laminated on the sealing film, layer laminated on the sealing film, and mixtures thereof The sealing film is for example provided with a means for lowering the initial tearing force. Such a means for lowering the initial tearing force is for example two cuts or two series of apertures or holes, According to a possible embodiment, the strip to be torn out of the seal film has a central portion located between said first end and second end, whereby the strip to be torn out has a width near its first end which is lower than the width of the central portion of the strip. This is advantageous as the portion of the strip near its first end is glued to the cartridge with less glue, whereby the tearing force is lowered at the glued section of the strip. Furthermore, after removal of the strip, the opening formed at the first end (for example between the face of the toner cartridge contacting a face of the support of the magnetic drain with interposition of at least a portion of sealing member) has a lowered section, whereby the risk of possible escape of toner through said opening is lowered.

According to another embodiment, the strip to be torn out of the seal film has a central portion located between said first end and second end, whereby the strip to be torn out has a width near its second end which is lower than the width of the central portion of the strip. This is advantageous as the portion of the strip near its second end is glued to the cartridge with Less glue, whereby the tearing force is lowered at the glued section of the strip. Furthermore, after removal of the strip, the opening formed at the second end has a lowered section, whereby the risk of possible escape of toner through said opening is lowered.

According to a detail of a preferred embodiment, the strip to be torn out of the seal film has a central portion located between said first end and second end, whereby the strip to be torn out has a width near its first and second ends which is lower than the width of the central portion of the strip.

According to a possible embodiment, the strip to be torn out of the seal film has a central portion located between said first end and second end, whereby the strip to be torn out has a width near its first end which is greater than the width of the central portion of the strip.

According to a specific embodiment, the control tearing means is a tape attached to a face of the seal film, said tape having a width corresponding substantially to the width of the strip to be torn, said tape having a length substantially lower than the length of the seal film. The tape is thus advantageously only located on the sealing film and does not extend on the tearing member.

According to another specific embodiment, the seal film comprises at least two superposed layers, and at least one control tearing means is located between the two superposed layers.

The seal film is preferably provided with gluing means for gluing the seal film on the cartridge. Possibly the two opposite faces of the sealing film can be provided with gluing means, so that said gluing means can be used for attaching or fixing together the toner container with the support bearing the magnetic roller.

The invention relates also to a tearable sealing member for unsealably sealing an opening of a developer container for containing a developer for an image forming apparatus, said tearable member comprising a seal film for closing the opening and a tearing member cooperating with the seal film for tearing a strip out of said seal film in a longitudinal direction, from a first end of the strip up to a second end of the strip, in which the seal film comprises at least two superposed layers, and at least a control tearing means located between the two layers. The fact to place the control tearing means between two superimposed layers of the film is advantageous as it enables to have less lateral movements and to improve thus the tearing direction.

In said tearable sealing member, the seal film comprises advantageously a first control tearing means for controlling at least the tearing direction along at least a portion of a first edge of the strip to be torn and a second control tearing means for controlling at least the tearing direction along at least a portion of a first edge of the strip to be torn located between the two layers, at least a portion of the first control tearing means being distant and separate from a portion of the second control tearing means.

For example, the two superimposed layers are connected together by means of at least 3 substantially parallel connecting lines, said lines being separated the one from the other so as to define therebetween a control tearing means.

Preferably, a chamber is defined between the two layers and at least between two substantially parallel connecting lines, the member further comprising a sealing means for sealing the chamber from the outside.

Most preferably, the layer intended to be directed towards the toner is provided with means selected from the group consisting of cuttings, holes, punctures, and mixtures thereof located between two substantially parallel connecting lines.

According to a preferred embodiment, the two superimposed layers are connected together by means of at least 4 substantially parallel connecting lines, said lines being separated the one from the other so as to define between two substantially connecting lines a first control tearing means and between two other substantially connecting lines a second control tearing means.

Advantageously, a chamber is defined between the two layers and at least between two substantially parallel connecting lines, the member further comprising a sealing means for sealing the chamber from the outside.

Preferably, the layer intended to be directed towards the toner is provided with means selected from the group consisting of cuttings, holes, punctures, and mixtures thereof located between two substantially parallel connecting lines.

According to a specific embodiment, the tearing member and the sealing film are formed in an assembly comprising a first layer and a second layer connected to the first layer, the first and second layers are connected together in the seal film:

by means of at least 3 substantially parallel connecting lines, said lines being separated the one from the other so as to define thereberween a control tearing means, and by means of at least one connecting lines in the tearing member.

According to a more specific embodiment, the tearing member and the sealing film are formed in an assembly comprising a first layer and a second layer connected to the first layer, the first and second layers are connected together in the seal film by means of at least 4 substantially parallel connecting lines, said lines being separated the one from the other so as to define between two substantially connecting lines a first control tearing means and between two other substantially connecting lines a second control tearing means, and by means of at least two substantially parallel connecting lines in the tearing member.

Preferably, a chamber is defined between the two layers and at least between two substantially parallel connecting lines, the member further comprising a sealing means for sealing the chamber from the outside.

Most preferably, the layer intended to be directed towards the toner is provided with means selected from the group consisting of cuttings, holes, punctures, and mixtures thereof located between two substantially parallel connecting lines.

According to an embodiment of the tearable sealing member, the seal film is provided with gluing means for gluing the seal film on the cartridge.

The invention relates also to a tearable sealing member for unsealably sealing an opening of a developer container for containing a developer for an image forming apparatus, said tearable member comprising a seal film for closing the opening and a tearing member cooperating with the seal film for tearing a strip out of said seal film in a longitudinal direction, in which at least a portion of the strip to be torn is connected to at least a tape portion connected to at least a handling means, said tape portion acting as tearing control means for at least a portion of the strip. Possibly the tape portion acting as handling means can be removed after placement. For facilitating its removal the connecting line of the handling means with the tape portion attached or glued on the film seal is provided with means for facilitating the removal (such as holes, cuts, grooves, punctures in the tape).

Preferably, the tape portion is connected to at least two distinct handling means According to an embodiment, the handling means (preferably each handling means, for example two or more than two, while two handling means seems to be sufficient for many cases) is pivotably connected to the tape portion, so that said handling means can be moved between a position in which the handling means is adjacent to the seal film and a handling position, for example a handling position in which the handling means is substantially perpendicular to the film seal.

According to an embodiment, the handling means (preferably each handling means) is connected to a first tape portion attached to the film seal and to a second tape portion attached to the film seal, said handling means being situated between said first and second tape portion.

Most preferably, the sealing member is associated to a tape, in which the handling means is connected to a first tape portion attached to the film seal and to a second tape portion attached to the film seal, said handling means being formed by a folded portion of the tape situated between said first and second tape portion. Advantageously, the folded portion comprises two tape portions attached to each other (for example glued to each other).

The handling means have for example a height comprised between 0.5 cm and 2 cm. Preferably the handling means are distant from each other by a distance corresponding to at least the height of the handling means or by a distance sufficient for avoiding that one handling means when adjacent to the seal film contacts or reach the pivoting line of another handling means.

The invention further relates to a tearable sealing member for unsealably sealing an opening of a developer container for containing a developer for an image forming apparatus, said tearable member comprising a seal film for closing the opening and a tearing member cooperating with the seal film for tearing a strip out of said seal film in a longitudinal direction, in which at least a portion of the strip to be torn is connected to at least a tape portion connected to at least a pivoting rib, said tape portion acting as tearing control means for at least a portion of the strip. The tape portion is advantageously connected to at least two distinct pivoting ribs, for example 3, 5, 7, 10 or even more. The ribs are advantageously parallel to each other and have a maximum height (calculated when the ribs are perpendicular to the seal film) of less than 1 cm, for example less than 0.5 cm, advantageously less than 3 mm.

Advantageously, the rib is pivotably connected to the tape portion, so that said rib is movable between a position in which the rib is adjacent to the seal film and a position in which the rib is substantially perpendicular to the seal film.

Preferably, the rib is connected to a first tape portion attached to the film seal and to a second tape portion attached to the film seal, said rib being situated between said first and second tape portion.

Most preferably, the rib is connected to a first tape portion attached to the film seal and to a second tape portion attached to the film seal, said rib being formed by a folded portion of the tape situated between said first and second tape portion. The folded portion comprises two tape portions attached to each other, for example glued together.

The invention further relates to a process for the manufacture of a tearable sealing member for unsealably sealing an opening of a developer container for containing a developer for an image forming apparatus, said tearable member comprising a seal film for closing the opening and a tearing member cooperating with the seal film for tearing a strip out of said seal film in a longitudinal direction, from a first end of the strip up to a second end of the strip, so as to define an opening, in which the seal film is provided with a means for controlling a minimum width of the strip to be torn out during at least its partial tearing, In which the control tearing means is printed on the seal films The invention still relates to:

a process for the manufacture of a tearable scaling member for unsealably sealing an opening of a developer container for containing a developer for an image forming apparatus, said tearable member comprising a seal film for closing the opening and a tearing member cooperating with the seal film for tearing a strip out of said seal film in a longitudinal direction, from a first end of the strip up to a second end of the strip, so as to define an opening, said seal film comprising two layers bound the one to the other, in which at least one layer is provided with a means for controlling a minimum width of the strip to be torn out during at least its partial tearing, In which the control tearing means is printed on said layer, and.

a process for the manufacture of a tearable sealing member for unsealably sealing an opening of a developer container for containing a developer for an image forming apparatus, said tearable member comprising a seal film for closing the opening and a tearing member cooperating with the seal film for tearing a strip out of said seal film in a longitudinal direction, from a first end of the strip up to a second end of the strip, so as to define an opening, said seal film comprising two layers bound the one to the other, in which at least one layer is provided with a means for controlling a minimum width of the strip to be torn out during at least its partial tearing, In which a first layer is provided with non adhesive lines, and in which a second layer is applied on said first layer and connected to said first layer between at least partly between two non adhesive lines.

Details and characteristics of the invention will appear from the following description in which reference is made to the attached drawings.

BRIEF DESCRIPTION OF THE DRAWINGS

In said drawings.

DESCRIPTION OF PREFERRED EMBODIMENTS

Figure 1:
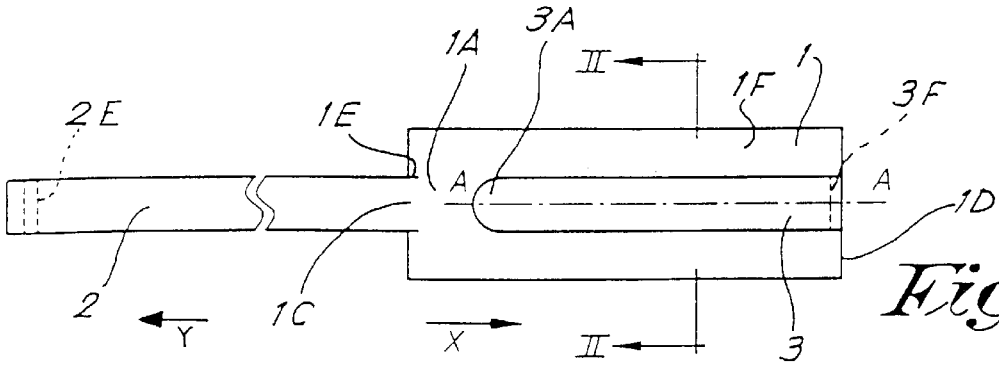
FIG. 1 is an upper plane view of an embodiment of a sealing member of the invention.
Figure 2:
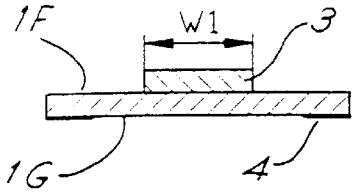
FIG. 2 is a cross section view along the lines II—II of the sealing member of FIG. 1.
Figure 3:
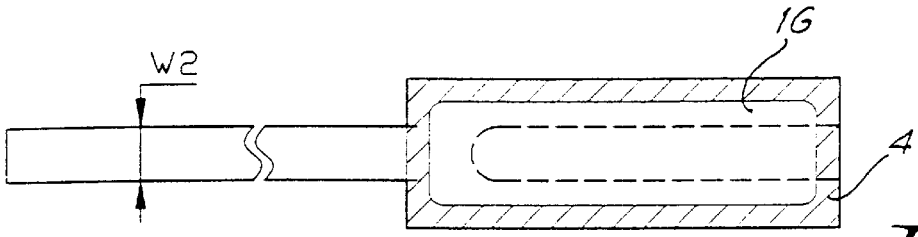
FIG. 3 is a back view of the sealing member of FIG. 1.

FIG. 1 is a schematic view of a sealing member of the invention.

The sealing member comprises a sealing film portion 1 for sealing the opening of a toner cartridge of a printer, laser printer, copier, etc., and a tearing member 2 (such as an elongated strip) for exerting a tearing force for tearing a strip 1A out of the sealing film portion 1. The sealing film portion 1 and the tearing member are portions of one single film layer made with in a material having an orientation so as to have a preferential longitudinal cutting (X). The strip 1A to be torn out of the film 1 extends from a first end 1C connected to the tearing member 2 up to a second opposite end 1D. Near its end 1C, the strip 1A is associated with two cuts 1E for lowering the initial tearing force. Said two cuts extend at least substantially in the longitudinal direction X of the film. Instead of using cuts 1E, it can be possible to use other means for lowering the initial tearing force, such as a plurality of holes and/or apertures and/or grooves. The length of the tearing member 2 is greater than the length (in the direction X or longitudinal direction) of the film seal 1.

Figure 26:
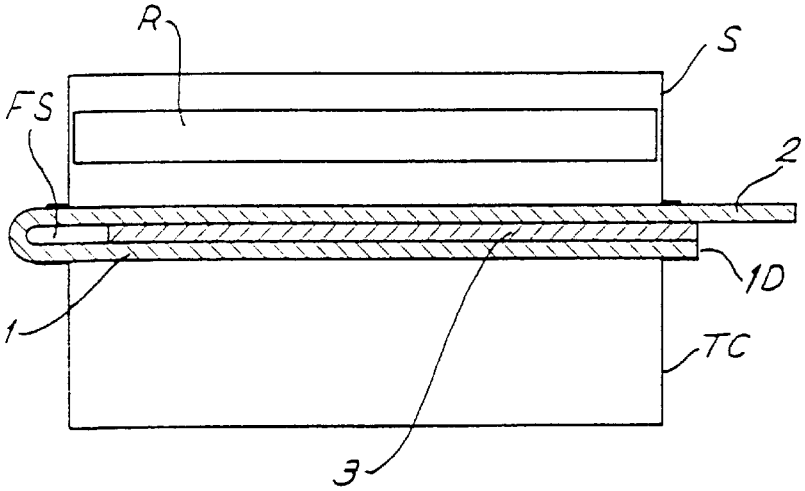
FIG. 26 shows schematically a toner cartridge provided with the sealing member of FIG. 1.
Figure 27:
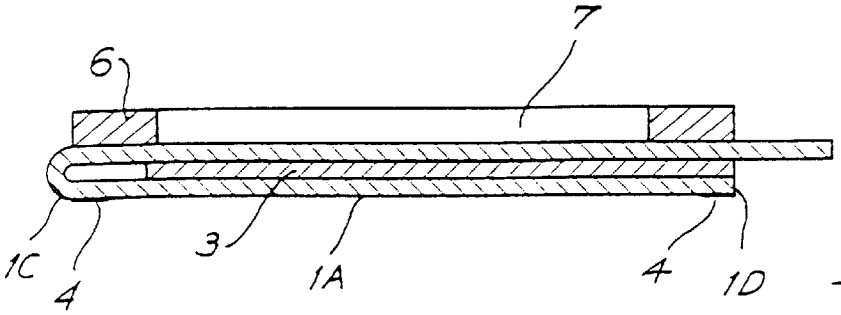
FIG. 27 is a view in cross section of FIG. 7.

The face 1F (face opposite to the face 1G intended to be directed towards the toner container) is provided with a tape 3. Said tape 3 is glued on or fused with the seal film 1. The tape 3 extends from the end 1D towards the end 1C. The end of the tape 3 directed towards the end 1C has a curved portion or a semi circular portion 3A. The tape 3 has a width W1 corresponding substantially to the width of the strip 1A to be torn out of the film 1 and has a central axis A—A parallel to the longitudinal cut direction X. As it can be seen, the tape 3 is away from the tearing member 23 and does not extend in said tearing member. This is advantageous so that the thickness of the bent portion of the strip after its initial tearing remains as low as possible. Indeed, before the tearing operation, the portion of the film 1A provided with the cuts 1E and a portion of the tearing member are pressed between a face of the toner container TC and a face of the support S bearing the magnetic roller R, whereby the tearing member 2 and the portion of the strip 1A adjacent to the end 1C have to be thin enough so as to avoid friction resistance after the initial tearing. The tape 3 acts also as means for lowering the risk of movement (in a direction Y opposite to the tearing direction X) of the tearing member 2 when the sealing member seals the toner cartridge (see FIG. 26). A higher contact pressure exists for the tearing member near the end 1D of the strip 1A. As it can be shown schematically on the FIG. 26, a free space FS is formed between the film 1 and the tearing member 2 bent onto the film 1. Said free space FS facilitates the tearing operation after the initial tearing.

The tape 3 can have a compressible structure, such as a foam structure.

Figure 24:
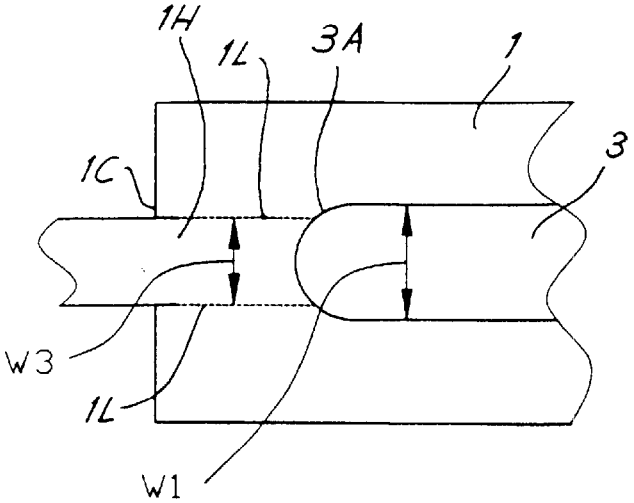
FIG. 24 is an enlarged view of a portion of the sealing member of FIG. 1.

The curved portion 3A is designed so that its width increases towards the end 1D. The curved portion 3A acts as control tearing means, as in case the width W3 of the portion of strip torn 1H (portion of the strip located between the end 1C and the tape 3, said portion being shown in dashed lines) is lower than the desired width W1 of the strip to be torn or opening to be formed, the cutting lines 1L abuts against the curved portion 3A whereby increasing the width (from W3 up to W1) of the further portion of the strip to be torn. (see FIG. 24) The cutting lines following the cutting lines 1L follow then the curved edge of the portion 3A.

The face 1G is provided along the edges of the seal film 1 with gluing means 4 for attaching the seal film on the toner container TC. Said gluing means can be protected by a removable paper or layer, such as siliconized paper.

In the embodiment of FIG. 1, the tearing member 2 has a width W2 corresponding substantially to the width W1 of the strip 1A to be torn.

Figure 4:
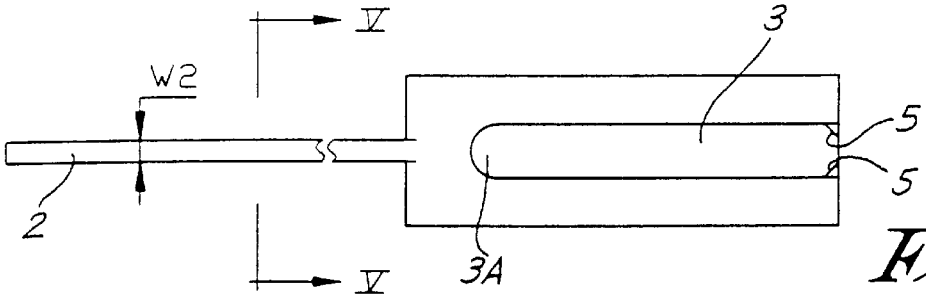
FIG. 4 is an upper plane view of another embodiment of a sealing member of the invention.
Figure 5:
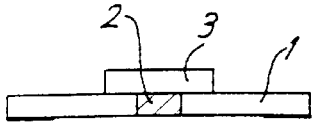
FIG. 5 is a cross section view along the lines V—V of the sealing member of FIG. 4.
Figure 6:
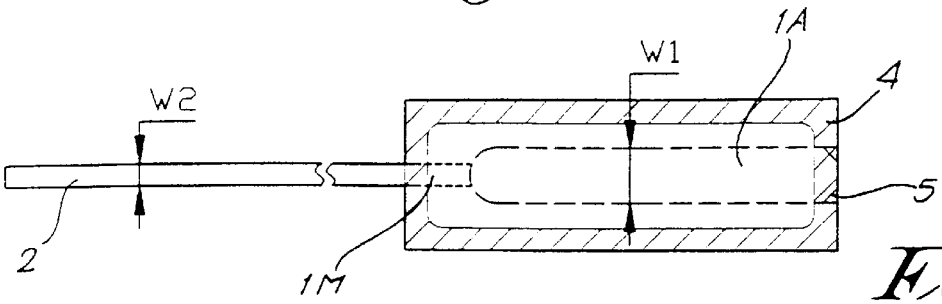
FIG. 6 is a back view of the sealing member of FIG. 4.

The embodiment of FIG. 4 is similar to the embodiment shown in FIG. 1, except that the width W2 of the tearing member is lower than the desired width W1 of the central portion of the strip 1A to be torn.

Figure 25:
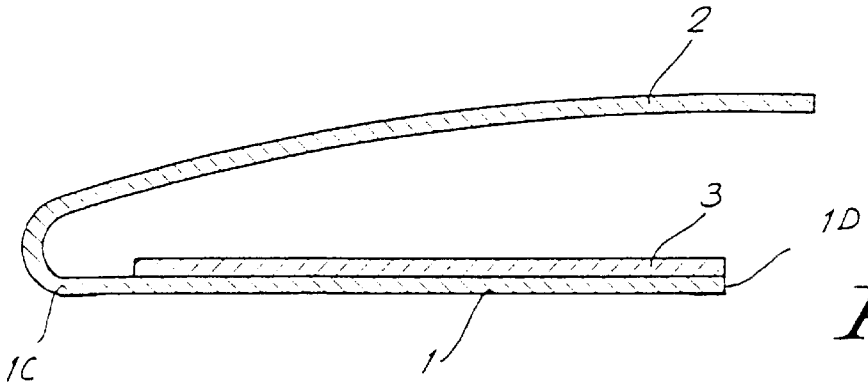
FIG. 25 is a view showing the operation of tearing the strip out of the sealing film

When tearing on the tearing member 2 (see FIG. 25) the strip 1 is torn out from its end 1C up to its end 1D. The strip 1 has a first portion 1M extending between the tearing member 2 and the tape 3, said portion 1M having a width corresponding substantially to the width W2 of the tearing member near the end 1C. It means that a portion 1M with less glue 4 has to be removed from the face of the toner container, i.e. less tearing force is required for said removal. The width of the strip to be torn is then increased by the curved portion 3A of the tape 3. In order to reduce the width of the strip 1 near its end 1D, two cuts 5 are provided. Said cuts extend for example in a direction forming an angle $\alpha$ of about 45° with the direction X. Said cuts have a length adapted for extending only in a portion of the film 1 provided with a glue layer 4.

Figure 7:
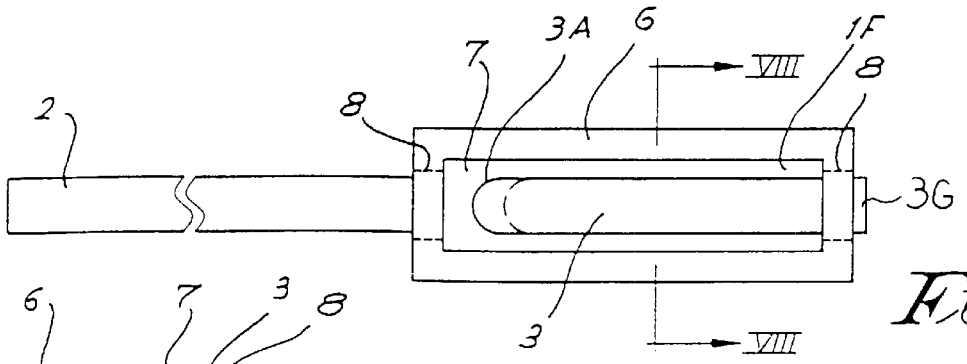
FIG. 7 is an upper plane view of still another embodiment of a sealing member of the invention.
Figure 8:
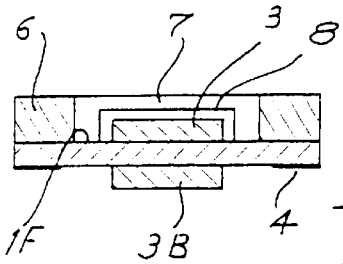
FIG. 8 is a cross section view along the lines VIII—VIII of the sealing member of FIG. 7.
Figure 9:
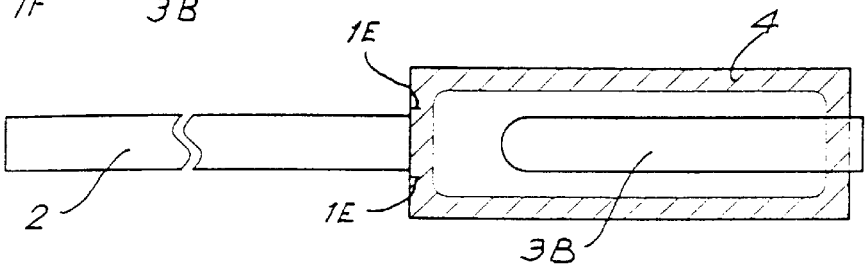
FIG. 9 is a back view of the sealing member of FIG. 7.

The embodiment of FIG. 7 is similar to the embodiment of FIG. 1, except that the face 1F of the seal film 1 is provide with a foamed insert 6 provided with a central slot 7. The tape 3 has a curved end 3A not covered by the foamed insert 6. The foamed insert is advantageously compressible and is formed with substantially closed cells.

The tape 3 has a portion 1G of the film, whereby a portion 3G of the tape extends outside the seal film 1 and outside of the foamed insert 6. The portion 3G consist of two portions of tape glued together. The tape 3 is placed and glued on the faces 1F and 1G of the film so that the portion of the tape covering the face 1F covers a portion of the film corresponding substantially to the portion of the film covered on its face 1G by the tape 3.

The foamed insert is advantageously provided with openings 8 for the passage of the tearing member 2 after its bending so as to place it above the face 1F.

Figure 10:
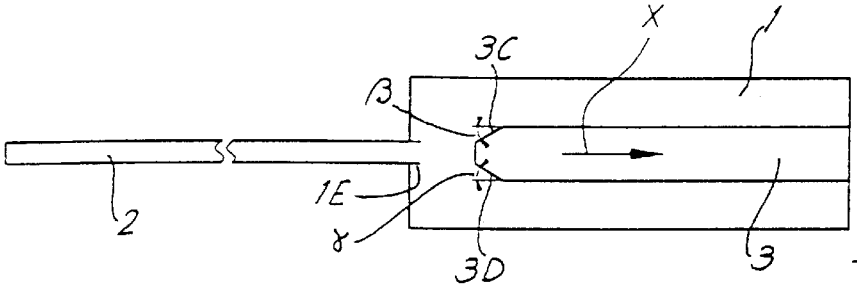
FIGS. 10 to 12 are plane views of further embodiments of the invention.

The embodiment of FIG. 10 is similar to the embodiment of FIG. 4, except that the end 3A of the tape 3 is not hemi circular, but is provided with two inclined edge portions 3C,3D, a first edge portion 3C forming an angle $\beta$ of about 30° with respect to the longitudinal cut direction X acting as means for controlling the tearing of the left edge of a portion of the strip 1, while the second edge portion 3D forming an angle $\gamma$ of about 30° with respect to the direction X acts as means for controlling the tearing of the right edge of a portion of the strip 1.

Figure 11:
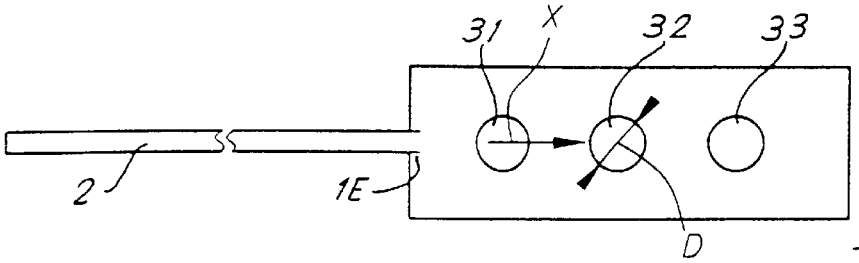

In the embodiment of FIG. 11, the control tearing means comprises a plurality of distinct patches 31,32,33(circular patches) fixed (for example by means of glue) on the face 1F of the film 1. Said patches ensure each a control of the tearing at a specific place of the film. The patches have a same diameter D and the centers of said patches are located substantially along a line substantially parallel to the direction X.

Figure 12:
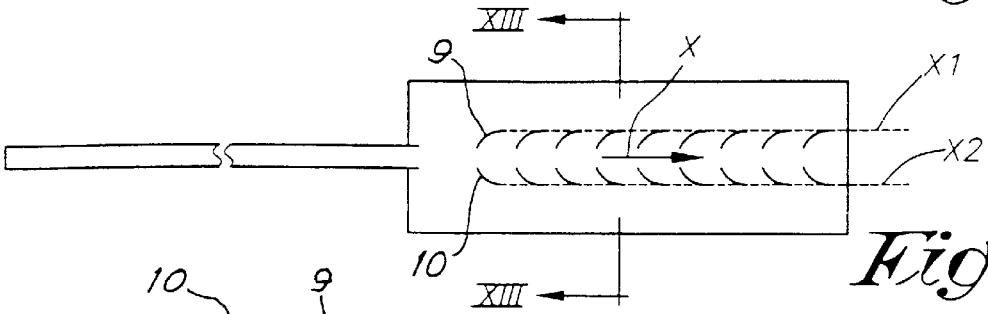
Figure 13:
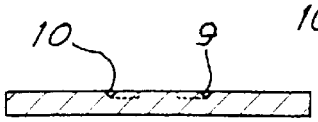
FIG. 13 is a cross section view along the lines XIII—XIII of the embodiment of FIG. 12.

In the embodiment of FIG. 12, the control tearing means comprises a series of grooves 9 for controlling successively the tearing of the left edge of the strip 1A and a series of grooves 10 for controlling successively the tearing of the right edge of the strip 1A. The grooves 9,10 have the shape of ¼ of a circle. The grooves 9 are located the one with respect to the other so that the left edge of the strip to be torn corresponds substantially to a line forming a tangent to the grooves 9, said line X1 (shown in dashed line in FIG. 12) being parallel to the longitudinal preferential cutting direction X. The grooves 10 are located the one with respect to the other so that the left edge of the strip to be torn corresponds substantially to a line forming a tangent to the grooves 10, said line X2 being parallel to the longitudinal preferential cutting direction X.

Figure 31:
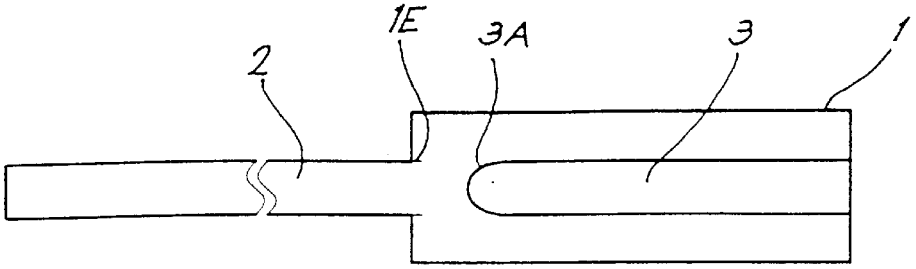
FIGS. 31 to 33 are views of embodiments similar to those of FIG. 7.
Figure 32:
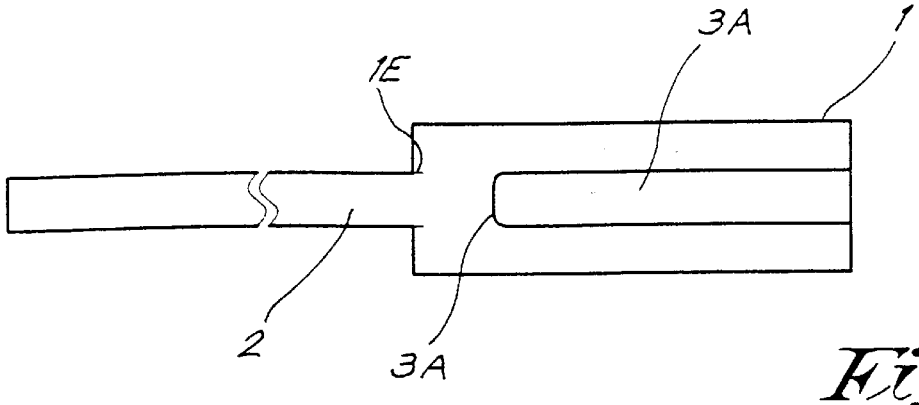
Figure 33:
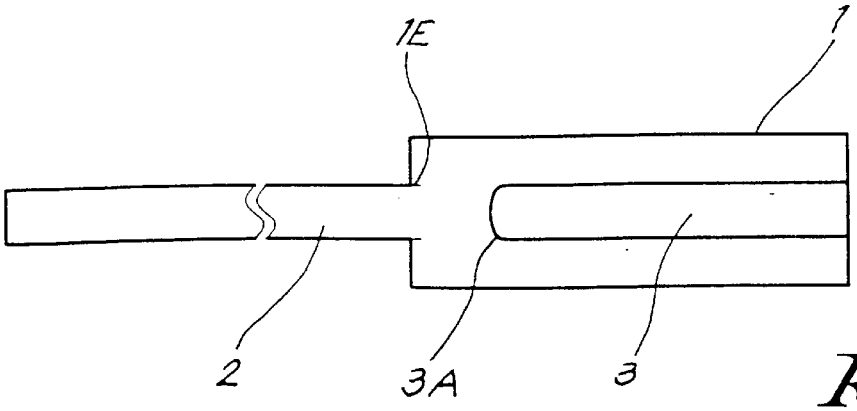

"FIGS. 31 to 33 are views of embodiments similar to that of FIG. 7, except that the end 3A comprises respectively portions of ellipses, portions of sinuses and portions of tangents."

Figure 14:
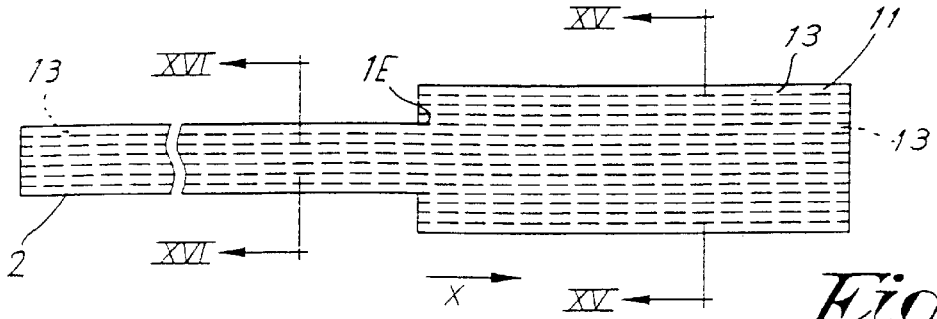
FIG. 14 is an upper plane view of a specific embodiment of the invention.
Figure 15:
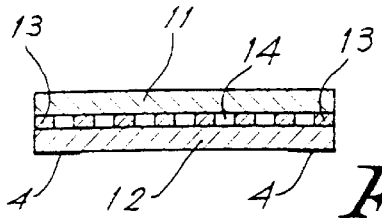
FIGS. 15 and 16 are cross section views along the lines XV—XV and XVI—XVI of the embodiment of FIG. 14.
Figure 16:
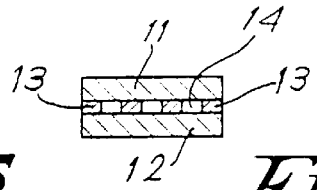

FIG. 14 shows a further embodiment of a sealing member provided with control tearing means. In the sealing film 1 and the tearing member or strip 2 are made in one single assembly comprising two distinct layers 11,12 connected the one to the other by a series of parallel connecting lines 13, said lines being parallel to the longitudinal preferential cutting direction X. Said connecting lines 13 are for to example made by melting together the two layers 11,12 along said lines 13 or by gluing together said layers 11,12. Between two adjacent connecting lines, a space 14 is free and acts as means for having a preferential cutting direction and for controlling the cutting of the strip when tearing it out of the film. The lateral edges (parallel to the tearing direction) of the tearing members are formed by a connecting line 13 connecting the layers 11,12.

Figure 17:
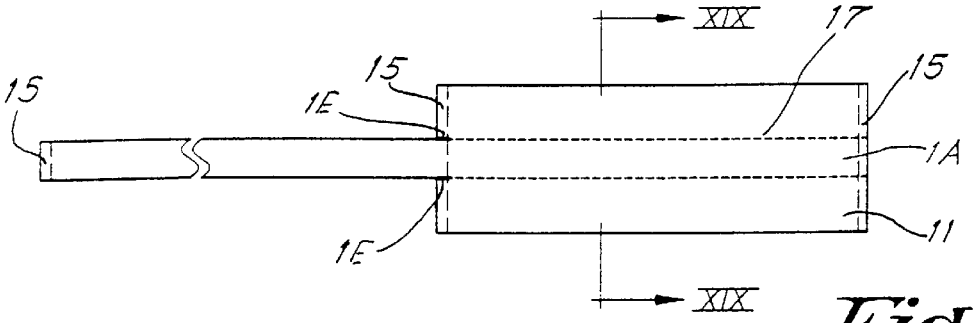
FIG. 17 is an upper view of an embodiment similar to that shown in FIG. 14
Figure 18:
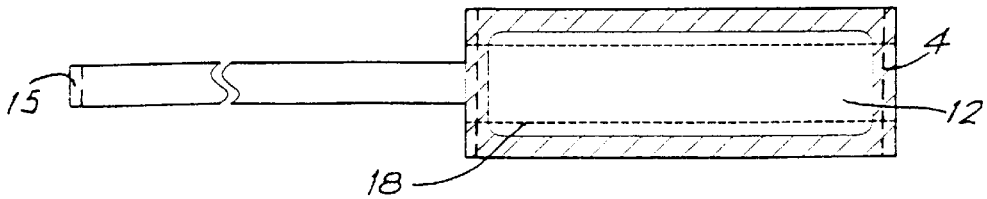
FIG. 18 is a back view of the embodiment of FIG. 17.
Figure 19:
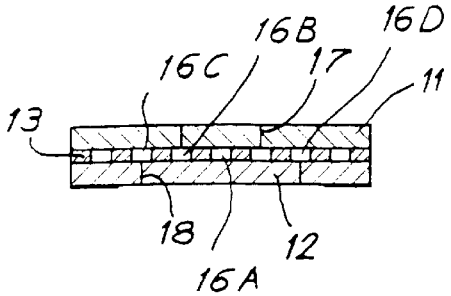
FIG. 19 is a cross section view along the lines XIX—XIX of the embodiment of FIG. 17.

FIG. 17 is a view of an embodiment similar to that shown in FIG. 14, except that the layers 11, 12 are further connected together by connecting lines 15 connecting the layers 11,12 along edges perpendicular to the direction X or perpendicular to the connecting lines 13. Said connecting lines 15 form with the 25 by layers 11,12 a plurality of closed spaces or chambers 16. Advantageously, the upper layer 11 and the lower layer 12 are provided with a series of successive holes or punctures 17,18 defining preferred cutting lines. The holes or punctures 17 are made in the top layer 11 between adjacent connecting lines 13 forming two distinct chambers 16A, 16B. The holes or punctures 18 are made in the lower layer 12 between adjacent connecting lines 13 forming two chambers 16C, 16D distinct from the chamber 16A, 16B. Possibly the layer 11 can be provided with holes or punctures or cuts 17 making a passage to a chamber 16 not in connection with a passage formed by holes, punctures, etc. of in the layer 12.

Figure 20:
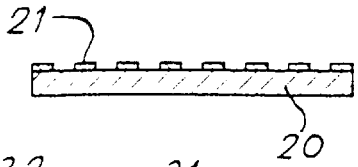
FIGS. 20 and 21 are schematic view showing a manufacturing process.
Figure 21:
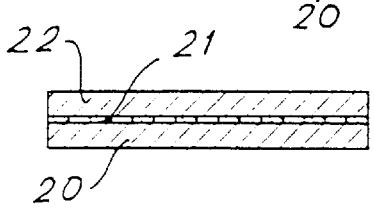

FIGS. 20 and 21 shows schematically process steps for the manufacturing of sealing member of the invention. In FIG. 20, a plastic film 20 is printed with lines 21 forming zones with anti adhesion properties. Another film 22 is then fixed to the plastic film 20 by melting or welding or extrusion.

The printing can also be made for defining an area suitable to improve the impact of wave energies so as to define fusing lines where the printing has been made.

Figure 22:
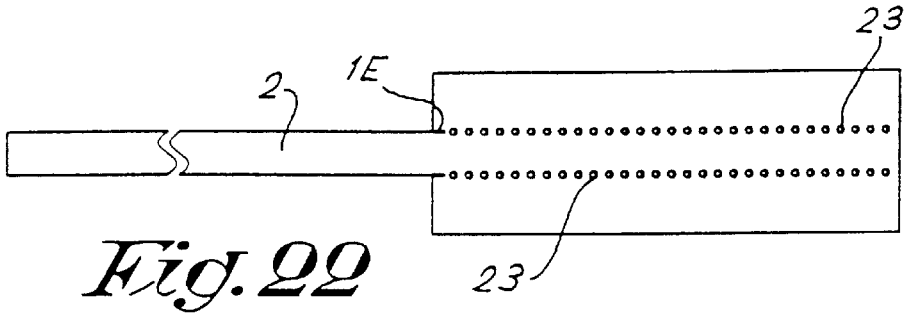
FIG. 22 shows schematically the printing of control tearing means on the film.

In FIG. 22, the strip 1A has been delimited by two rows 23 of printing points forming each a zone with a higher breaking.

Figure 23:
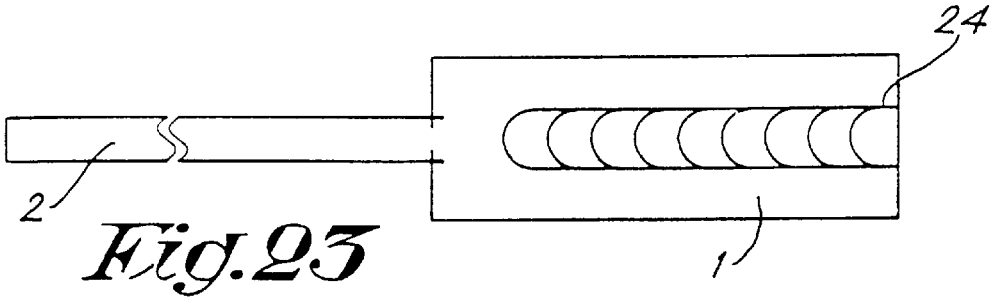
FIG. 23 is a further view of a control means printed (for example laser printed or ink-jet printed) on a sealing film.

In FIG. 23, some control tearing lines 24 have been printed on a face 1F of the film 1.

The tape 3 used in the example can be a polyethylene tape, a polypropylene tape, a PE/PP tape, a polyurethane tape, a polyester tape, a PVC tape, a rubber tape, a polyamide tape, a paper tape, a thin metal tape, an aluminium tape, a copper tape, etc. or a mixture thereof. The tape 3 is advantageously thicker than the sealing film. For example the tape has a thickness comprised between 50 $\mu$m and 2000 $\mu$m, advantageously between 100 $\mu$m and 1000 $\mu$m.

The tape 3 is for example glued on the film 1, but can be fused or welded together. The tape 3 can be replaced by a layer (continuous or not, possibly forming only a specific design, such as lines, curved lines, dashed lines, successive adjacent points, etc.) of a material deposited directly on the film 1 or forming a partial intermediate layer. The layer is then attached on the film 1 after drying (evaporation of the solvent or liquid medium) and/or after curing, etc. The layer can also be hot deposited on the film so as to form directly an adhesion with the film 1.

The layer is for example an ink layer, a polyacrylate layer, a polymethacrylate layer, a paint layer, polyurethane layer, a resin layer, a polyethylene layer, a silicone layer, a PTFE layer, a metal layer, etc., said layer being possibly charged with filler, fibres, mats, a fabric, etc.

Figure 28:
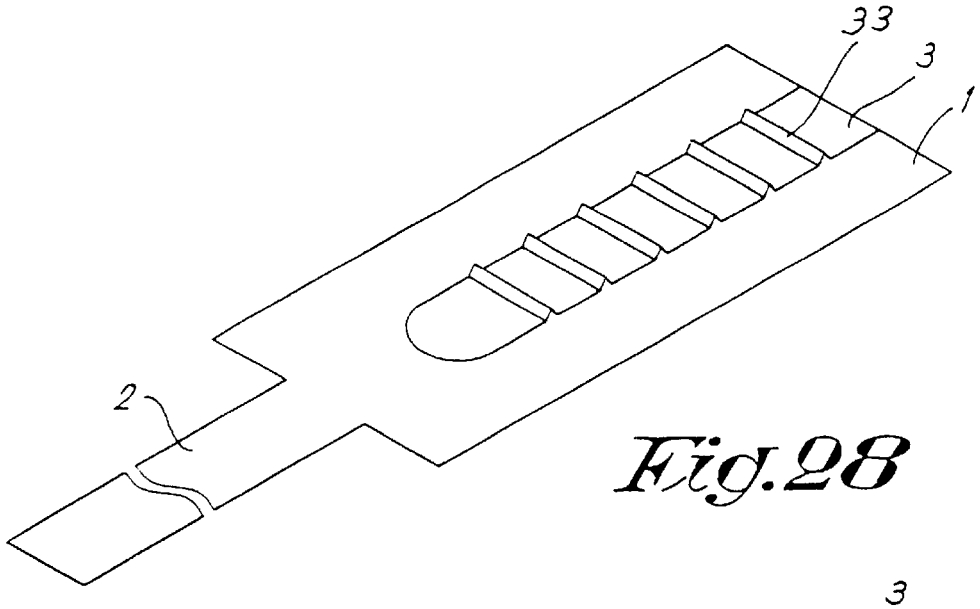
FIG. 28 is a perspective view of a further embodiment of a sealing member of the invention.

For facilitating the placement of the sealing member on a toner container or cartridge, the sealing film can be connected to one or more means rigidifying the sealing film, or increasing the rigidity of the sealing film during its placement. According to a possible embodiment, the tape 3 is connected to the rigidifying means, and is more particularly a portion of the rigidifying means. The tape 3 as such can have a sufficient rigidity. For example the tape 3 is provided with a plurality of ribs 33 substantially perpendicular to the tearing direction (see FIG. 28), said ribs being advantageously able to pivot or rotate with respect to the tape 3. The ribs can act as handling means.

Figure 29:
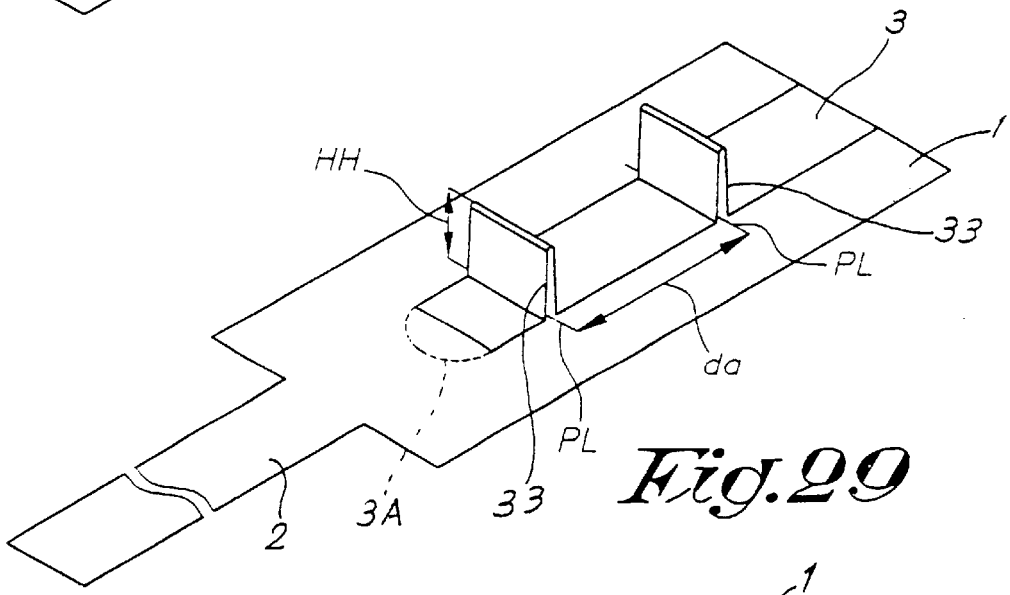
FIGS. 29 and 30 are perspective views of still a further embodiment of a sealing member of the invention provided with handling means in handling position and in folded position.
Figure 30:
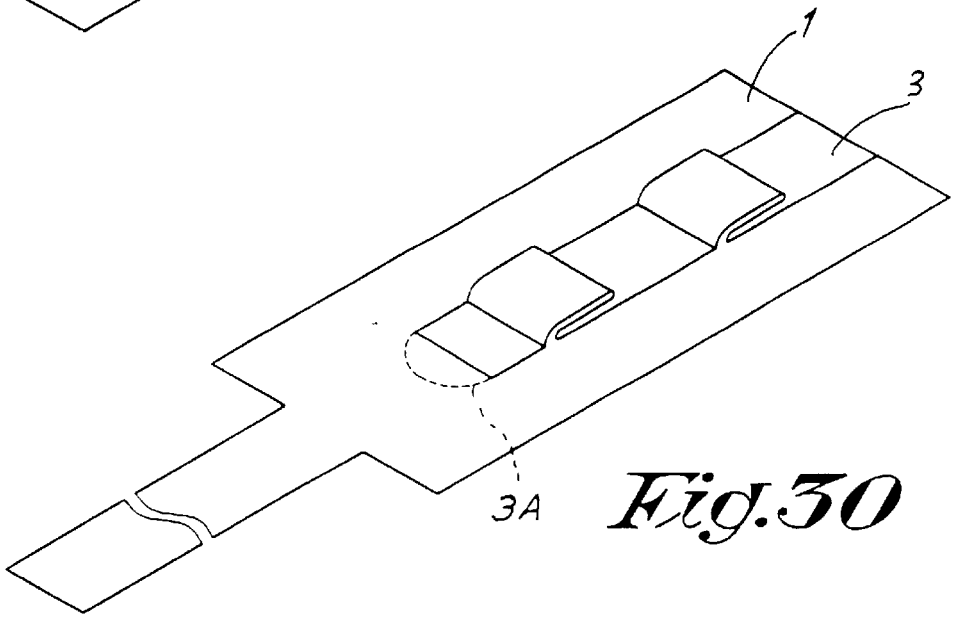

For facilitating the placement of the sealing member on a toner container or cartridge, the sealing film can be connected to one or more means rigidifying the sealing film, or increasing the rigidity of the sealing film during its placement. According to a possible embodiment, the tape 3 is connected to the rigidifying means, and is more particularly a portion of the rigidifying means. The tape 3 as such can have a sufficient rigidity. For example the tape 3 is provided with a plurality of ribs 33 substantially perpendicular to the tearing direction (see FIG. 28), said ribs being advantageously able to pivot or rotate In the embodiment of FIG. 29, the ribs 33 are adapted for holding the sealing member during its placement. Said ribs are adapted to be folded down along the film 1(see FIG. 30) before and after the placement of the sealing member. The end of the tape 3 is advantageously curved as shown in FIG. 1 (as shown in FIGS. 29 and 30 in dashed lines 3A).

The ribs 33 are for example formed by two portions of the tape 3 which are glued together.

The film 1 can be provided with a glue layer 4 (as in the embodiment of FIG. 1) and/or with a foam layer 6 (as in the embodiment of FIG. 7).

The ribs 33 (which are parallel to each other and which form fins substantially perpendicular to the longitudinal direction X when in its handling position) are distant from each other by a distance "da" (distance between the pivoting lines PL) which is greater than the height HH of the rib 33.

What I claim is:

1. Tearable sealing member for unsealably sealing an opening of a developer container for containing a developer for an image forming apparatus, said tearable member comprising a seal film for closing the opening and a tearing member cooperating with the seal film for tearing a strip out of said seal film in a longitudinal direction, from a first end of the strip up to a second end of the strip, so as to define an opening, in which the seal film is provided with a means for controlling a minimum width of the strip to be torn out during at least its partial tearing, said control means defining at least a control tearing line selected from the group consisting of a at least partly curved control tearing line, a control tearing line with at least a portion extending in a direction forming an angle with respect to the longitudinal tearing direction and a control tearing line with a portion having at least a curved portion and a portion extending in a direction forming an angle with respect to the longitudinal tearing direction.

2. The tearable sealing member of claim 1, in which the control tearing line is selected from the group consisting of an at least partly curved control tearing line, a control tearing line with at least a portion extending in a direction forming an angle comprised between 2° and 88° with respect to the longitudinal tearing direction and a control tearing line with a portion having at least a curved portion and a portion extending in a direction forming an angle comprised between 2° and 88° with respect to the longitudinal tearing direction.

3. The tearable sealing member of claim 1, in which the seal film and the tearing member are portions of a single film structure.

4. The tearable sealing member of claim 1, in which the at least curved control tearing line is selected from the group consisting of portion of substantially circular lines, portions of ellipses, portions of sinuses and portions of tangents.

5. The tearable sealing member of claim 1, which comprises a plurality of control means defining two or more control tearing lines distant from each other in the longitudinal direction, each control means being selected from the group consisting of a at least partly curved control tearing line, a control tearing line with at least a portion extending in a direction forming an angle with respect to the longitudinal tearing direction and a control tearing line with a portion having at least a curved portion and a portion extending in a direction forming an angle with respect to the longitudinal tearing direction.

6. The tearable sealing member of claim 1, which comprises at least a control means defining a first control tearing line for at least a portion of a first edge of the strip to be torn and a second control tearing line for at least a portion of a second edge of the strip to be torn, each control tearing line being selected from the group consisting of a at least partly curved control tearing line, a control tearing line with at least a portion extending in a direction forming an angle with respect to the longitudinal tearing direction and a control tearing line with a portion having at least a curved portion and a portion extending in a direction forming an angle with respect to the longitudinal tearing direction.

7. The tearable sealing member of claim 1, which comprises at least a control means defining a first control tearing line for at least a portion of a first edge of the strip to be torn and a second control tearing line for at least a portion of a second edge of the strip to be torn, said first and second control tearing lines being each associated to a substantially linear tearing line substantially parallel to the longitudinal tearing direction, said first and second control tearing lines being selected from the group consisting of a at least partly curved control tearing line, a control tearing line with at least a portion extending in a direction forming an angle with respect to the longitudinal tearing direction and a control tearing line with a portion having at least a curved portion and a portion extending in a direction forming an angle with respect to the longitudinal tearing direction.

8. The tearable sealing member of claim 1, in which the seal film has two opposite faces, each face being provided with at least one control tearing means.

9. The tearable sealing member of the previous claim, in which the control tearing means present on a first face of the seal film and the control tearing means present on the second face of the seal film opposite to the first face are linked together at least in the vicinity of the second end of the strip.

10. The tearable sealing member of the previous claim, in which the first control tearing means and the second control tearing means are connected together outside of the sealing film.

11. The tearable sealing member of claim 1, in which the control tearing means is formed by a means selected from the group consisting of a layer applied on a portion of the sealing film, an additional film applied on a portion of the sealing film, a groove formed in the sealing film, recesses formed in the sealing film, elements printed on a portion of the sealing film, elements glued on a portion of the seal film, elements laminated on the sealing film, layer laminated on the sealing film, and mixtures thereof.

12. The tearable sealing member of claim 1, in which the sealing film is provided with a means for lowering the initial tearing force.

13. The tearable sealing member of claim 1, in which the strip to be torn out of the seal film has a central portion located between said first end and second end, whereby the strip to be torn out has a width near its first end which is lower than the width of the central portion of the strip.

14. The tearable sealing member of claim 1, in which the strip to be torn out of the seal film has a central portion located between said first end and second end, whereby the strip to be torn out has a width near its second end which is lower than the width of the central portion of the strip.

15. The tearable sealing member of claim 1, in which the strip to be torn out of the seal film has a central portion located between said first end and second end, whereby the strip to be torn out has a width near its first and second ends which is lower than the width of the central portion of the strip.

16. The tearable sealing member of claim 1, in which the strip to be torn out of the seal film has a central portion located between said first end and second end, whereby the strip to be torn out has a width near its first end which is greater than the width of the central portion of the strip.

17. The tearable sealing member of claim 1, in which the control tearing means is a tape attached to a face of the seal film, said tape having a width corresponding substantially to the width of the strip to be torn, said tape having a length substantially lower than the length of the seal film.

18. The tearable sealing member of claim 1, in which the seal film comprises at least two superposed layers, and in which at least one control tearing means is located between tile two superposed layers.

19. The tearable sealing member of claim 1, in which the seal film is provided with gluing means for gluing the seal film on the cartridge.

20. A tearable sealing member for unsealably sealing an opening of a developer container for containing a developer for an image forming apparatus, said tearable member comprising a seal film for closing the opening and a tearing member cooperating with the seal film for tearing a strip out of said seal film in a longitudinal direction, from a first end of the strip up to a second end of the strip, in which the seal film comprises at least two superposed layers, and at least a control tearing means located between the two layers, and in which the seal film comprises a first control tearing means for controlling at least the tearing direction along at least a portion of a first edge of the strip to be torn and a second control tearing means for controlling at least the tearing direction along at least a portion of a first edge of the strip to be torn located between the two layers, at least a portion of the first control tearing means being distant and separate from a portion of the second control tearing means.

21. A tearable sealing member for unsealably sealing an opening of a developer container for containing a developer for an image forming apparatus, said tearable member comprising a seal film for closing the opening and a tearing member cooperating with the seal film for tearing a strip out of said seal film in a longitudinal direction, from a first end of the strip up to a second end of the strip, in which the seal film comprises at least two superposed layers, and at least a control tearing means located between the two layers, and in which the two superimposed layers are connected together by means of at least 3 substantially parallel connecting lines, said lines being separated the one from the other so as to define therebetween a control tearing means.

22. The tearable sealing member of claim 21, in which a chamber is defined between the two layers and at least between two substantially parallel connecting lines, the member further comprising a sealing means for sealing the chamber from the outside.

23. The tearable sealing member of claim 22, in which the layer intended to be directed towards the toner is provided with means selected from the group consisting of cuttings, holes, punctures, and mixtures thereof located between two substantially parallel connecting lines.

24. The tearable sealing member of claim 21, in which the tearing member and the sealing film are formed in an assembly comprising a first layer and a second layer connected to the first layer, the first and second layers are connected together in the seal film by means of at least 4 substantially parallel connecting lines, said lines being separated the one from the other so as to define between two substantially connecting lines a first control tearing means and between two other substantially connecting lines a second control tearing means, and by means of at least two substantially parallel connecting lines in the tearing member.

25. The tearable sealing member of claim 24, in which a chamber is defined between the two layers and at least between two substantially parallel connecting lines, the member further comprising a sealing means for sealing the chamber from the outside.

26. The tearable sealing member of claim 25, in which the layer intended to be directed towards the toner is provided with means selected from the group consisting of cuttings, holes, punctures, and mixtures thereof located between two substantially parallel connecting lines.

27. A tearable sealing member for unsealably sealing an opening of a developer container for containing a developer for an image forming apparatus, said tearable member comprising a seal film for closing the opening and a tearing member cooperating with the seal film for tearing a strip out of said seal film in a longitudinal direction, from a first end of the strip up to a second end of the strip, in which the seal film comprises at least two superposed layers, and at least a control tearing means located between the two layers, and, in which the two superimposed layers are connected together by means of at least 4 substantially parallel connecting lines, said lines being separated the one from the other so as to define between two substantially connecting lines a first control tearing means and between two other substantially connecting lines a second control tearing means.

28. The tearable sealing member of claim 27, in which a chamber is defined between the two layers and at least between two substantially parallel connecting lines, the member further comprising a sealing means for sealing the chamber from the outside.

29. The tearable sealing member of claim 28, in which the layer intended to be directed towards the toner is provided with means selected from the group consisting of cuttings, holes, punctures, and mixtures thereof located between two substantially parallel connecting lines.

30. A tearable sealing member for unsealably sealing an opening of a developer container for containing a developer for an image forming apparatus, said tearable member comprising a seal film for closing the opening and a tearing member cooperating with the seal film for tearing a strip out of said seal film in a longitudinal direction, from a first end of the strip up to a second end of the strip, in which the seal film comprises at least two superposed layers, and at least a control tearing means located between the two layers, and in which the tearing member and the sealing film are formed in an assembly comprising a first layer and a second layer connected to the first layer, the first and second layers are connected together in the seal film by means of at least 3 substantially parallel connecting lines, said lines being separated the one from the other so as to define therebetween a control tearing means, and by means of at least one connecting lines in the tearing member.

31. Tearable sealing member for unsealably sealing an opening of a developer container for containing a developer for an image forming apparatus, said tearable member comprising a seal film for closing the opening and a tearing member cooperating with the seal film for tearing a strip out of said seal film in a longitudinal direction, in which at least a portion of the strip to be torn is connected to at least a tape portion connected to at least a handling means, said tape portion acting as tearing control means for at least a portion of the strip.

32. The sealing member of the previous claim, in which the tape portion is connected to at least two distinct handling means.

33. The sealing member of claim 31, in which the handling means is pivotably connected to the tape portion, so that said handling means can be moved between a position in which the handling means is adjacent to the seal film and a handling position.

34. The sealing member of claim 31, in which the handling means is pivotably connected to the tape portion, so that said handling means can be moved between a position in which the handling means is adjacent to the seal film and a handling position in which the handling means is substantially perpendicular to the film seal.

35. The sealing member of claim 31, in which the handling means is connected to a first tape portion attached to the film seal and to a second tape portion attached to the film seal, said handling means being situated between said first and second tape portion.

36. The sealing member of claim 31, which is associated to a tape, in which the handling means is connected to a first tape portion attached to the film seal and to a second tape portion attached to the film seal, said handling means being formed by a folded portion of the tape situated between said first and second tape portion.

37. The sealing member of the preceding claim, in which the folded portion comprises two tape portions attached to each other.

38. Tearable sealing member for unsealably sealing an opening of a developer container for containing a developer for an image forming apparatus, said tearable member comprising a seal film for closing the opening and a tearing member cooperating with the seal film for tearing a strip out of said seal film in a longitudinal direction, in which at least a portion of the strip to be torn is connected to at least a tape portion connected to at least a pivoting rib, said tape portion acting as tearing control means for at least a portion of the strip.

39. The sealing member of the previous claim, in which the tape portion is connected to at least two distinct pivoting ribs.

40. The sealing member of claim 38, in which the rib is pivotably connected to the tape portion, so that said rib is movable between a position in which the rib is adjacent to the seal film and a position in which the rib is substantially perpendicular to the seal film.

41. The sealing member of claim 38, in which the rib is connected to a first tape portion attached to the film seal and to a second tape portion attached to the film seal, said rib being situated between said first and second tape portion.

42. The sealing member of claim 38, which is associated to a tape, in which the rib is connected to a first tape portion attached to the film seal and to a second tape portion attached to the film seal, said rib being formed by a folded portion of the tape situated between said first and second tape portion.

43. The sealing member of the preceding claim, in which the folded portion comprises two tape portions attached to each other.

44. A process for the manufacture of a tearable sealing member for unsealably sealing an opening of a developer container for containing a developer for an image forming apparatus, said tearable member comprising a seal film for closing the opening and a tearing member cooperating with the seal film for tearing a strip out of said seal film in a longitudinal direction, from a first end of the strip up to a second end of the strip, so as to define an opening, in which the seal film is provided with a means for controlling a minimum width of the strip to be torn out during at least its partial tearing, in which the control tearing means is printed on the seal film.

45. A process for the manufacture of a tearable sealing member for unsealably sealing an opening of a developer container for containing a developer for an image forming apparatus, said tearable member comprising a seal film for closing the opening and a tearing member cooperating with the seal film for tearing a strip out of said seal film in a longitudinal direction, from a first end of the strip up to a second end of the strip, so as to define an opening, said seal film comprising two layers bound the one to the other, in which at least one layer is provided with a means for controlling a minimum width of the strip to be torn out during at least its partial tearing, in which the control tearing means is printed on said layer.

46. A process for the manufacture of a tearable sealing member for unsealably sealing an opening of a developer container for containing a developer for an image forming apparatus, said tearable member comprising a seal film for closing the opening and a tearing member cooperating with the seal film for tearing a strip out of said seal film in a longitudinal direction, from a first end of the strip up to a second end of the strip, so as to define an opening, said seal film comprising two layers bound the one to the other, in which at least one layer is provided with a means for controlling a minimum width of the strip to be torn out during at least its partial tearing, in which a first layer is provided with non adhesive lines, and in which a second layer is applied on said first layer and connected to said first layer between at least partly between two non adhesive lines.

* * * * *